US006048131A

United States Patent [19]

Laak

[11] Patent Number: 6,048,131

[45] Date of Patent: Apr. 11, 2000

[54] SUBTERRANEAN FLUID FILTERING AND DRAINAGE SYSTEM

[76] Inventor: Rein Laak, 149 Browns Rd., Mansfield, Conn. 06268-2808

[21] Appl. No.: 09/080,339

[22] Filed: May 15, 1998

[51] Int. Cl.[7] ..... E02B 11/00

[52] U.S. Cl. ..... 405/43; 405/45; 405/36; 52/169.5

[58] Field of Search ..... 405/36, 43, 45, 405/48, 50; 52/169.5

[56] References Cited

U.S. PATENT DOCUMENTS

| | | | |
|---|---|---|---|
| 4,182,580 | 1/1980 | Hieda et al. | 405/43 |
| 4,182,581 | 1/1980 | Uehara et al. | 405/43 |
| 4,490,072 | 12/1984 | Glasser | 405/45 |
| 4,639,165 | 1/1987 | Flecknoe-Brown | 405/45 |
| 4,880,333 | 11/1989 | Glasser et al. | 405/45 |

*Primary Examiner*—David Bagnell
*Assistant Examiner*—Frederick Lagman
*Attorney, Agent, or Firm*—McCormick, Paulding & Huber LLP

[57] ABSTRACT

A fluid drainage and filtering system composed of stocked in-drains and spacers wrapped serpentine fashion with a non-woven fabric of fluid pervious material. Each in-drain has a dimpled core sheet defining spaced lands and surrounding valleys and a thickness related to the pitch distance between these lands. Each spacer has outer sheets of about ½ the thickness of the core sheet, but also having lands surrounded by valleys. The pitch distance of the lands in these outer sheets is also about ½ that of the thicker core sheets so the spacers and in-drains do not tend to nest into one another when the system is installed.

11 Claims, 3 Drawing Sheets

SUBTERRANEAN FLUID FILTERING AND DRAINAGE SYSTEM

This invention relates generally to drainage systems for filtering and distributing fluids such as leachate, and deals more particularly with an improved system having all of the advantages of those described in prior art U.S. Pat. No. 4,880,333 without many of its disadvantages.

BACKGROUND OF THE INVENTION

In the system described in the prior art U.S. Pat. No. 4,880,333, a plurality of core sheets of identical geometry are wrapped serpentine fashion with a geotextile fabric so as to provide a continuous horizontally extending stack of in-drains in an excavation that preferably includes a layer of sand and other fill so that leachate can be fed from a septic system or tank through a fluid conduit provided above the stack of in-drains for purposes of distributing the leachate downwardly through openings in the overlying fluid conduit means in an efficient fashion.

It has been found that when identical core sheets of this type are stacked together with a geotextile fabric being the only separation between them, that back filling and/or handling of this setup tends to cause the initially separated core sheets with the wrapped geotextile fabric, to be compressed one core sheet nesting into the other, leading to areas of the overall system which fail to serve their intended purpose.

The general object of the present invention is to provide an improved stack of such in-drains comprising core sheets and overwrapped geotextile fabric that avoid this propensity for compression during the back filling and/or handling operation (installation).

SUMMARY OF THE INVENTION

This object is accomplished by spacing in-drains, of core sheets and geotextile fabric, to permit spacers between the in-drains. The spacers and the in-drains are wrapped serpentine fashion to leave the tops of the in-drains uncovered, but the tops of the spacers covered. Each spacer has outer layers or sheets with closely spaced lands that do not tend to nest with the more widely spaced lands in the core sheets of the in-drains.

DETAILED DESCRIPTION

The disclosure in the prior U.S. Pat. No. 4,880,333 is incorporated by reference herein, and illustrates a stack of wrapped core sheets in an assembly that affords many of the advantages of the present invention, but which does exhibit the disadvantage whereby the core sheets contend to nest one within another, defeating the purpose of leaving sufficient open space a fluid leachate that is being returned to the soil.

Figure 2:
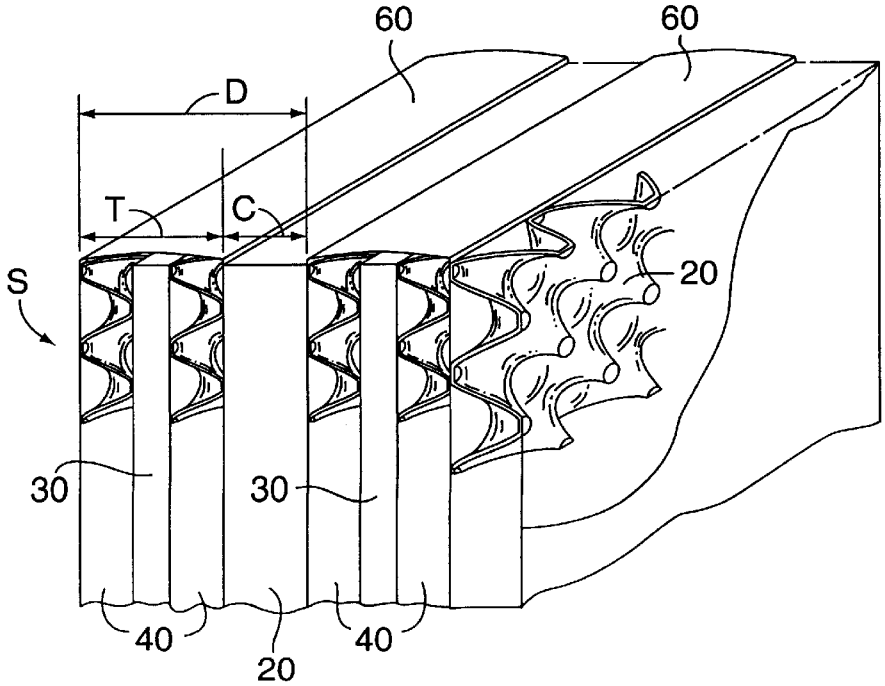
FIG. 2 is a partial perspective view of a portion of the stacked in-drains provided in accordance with the present invention.

Whereas the prior '333 Patent suggests using core sheets of similar contour between the serpentine wrapped geotextile fabric to provide an overall assembly of like core sheets and/or spacers of equal size, the present invention instead suggests the use of core sheets of different overall thickness and also of different geometry. More particularly, and as best shown in FIG. 2, the core sheets indicated generally at 20, are approximately 1¼ inches in overall width, and hence have raised and depressed areas that are spaced from one another by approximately 1¼ inch. More particularly, the pitch distance of the raised portions would be on the order of 1¼ inch when taken along a diagonal direction as suggested in FIG. 3.

Figure 1:
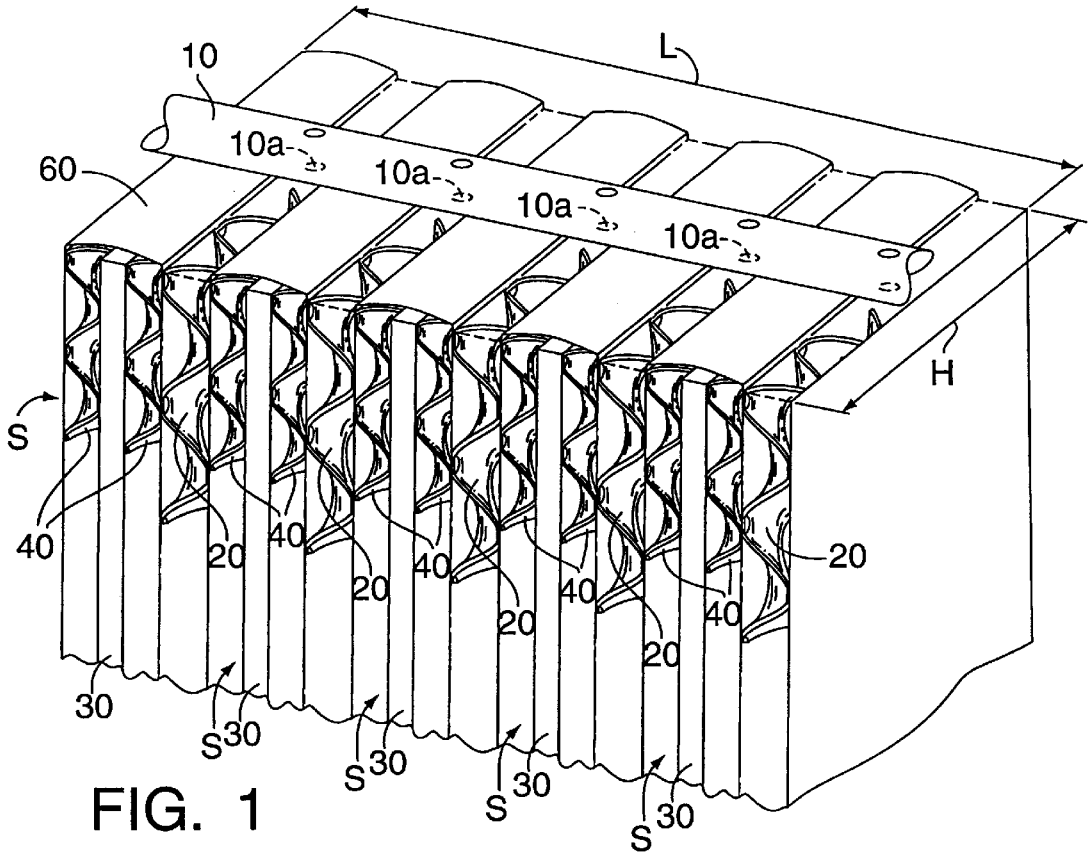
FIG. 1 is an overall perspective view illustrating a fluid conduit for delivering the leachate to the stacked in-drain provided in spaced relationship to one another in accordance with the present invention.
Figure 3:
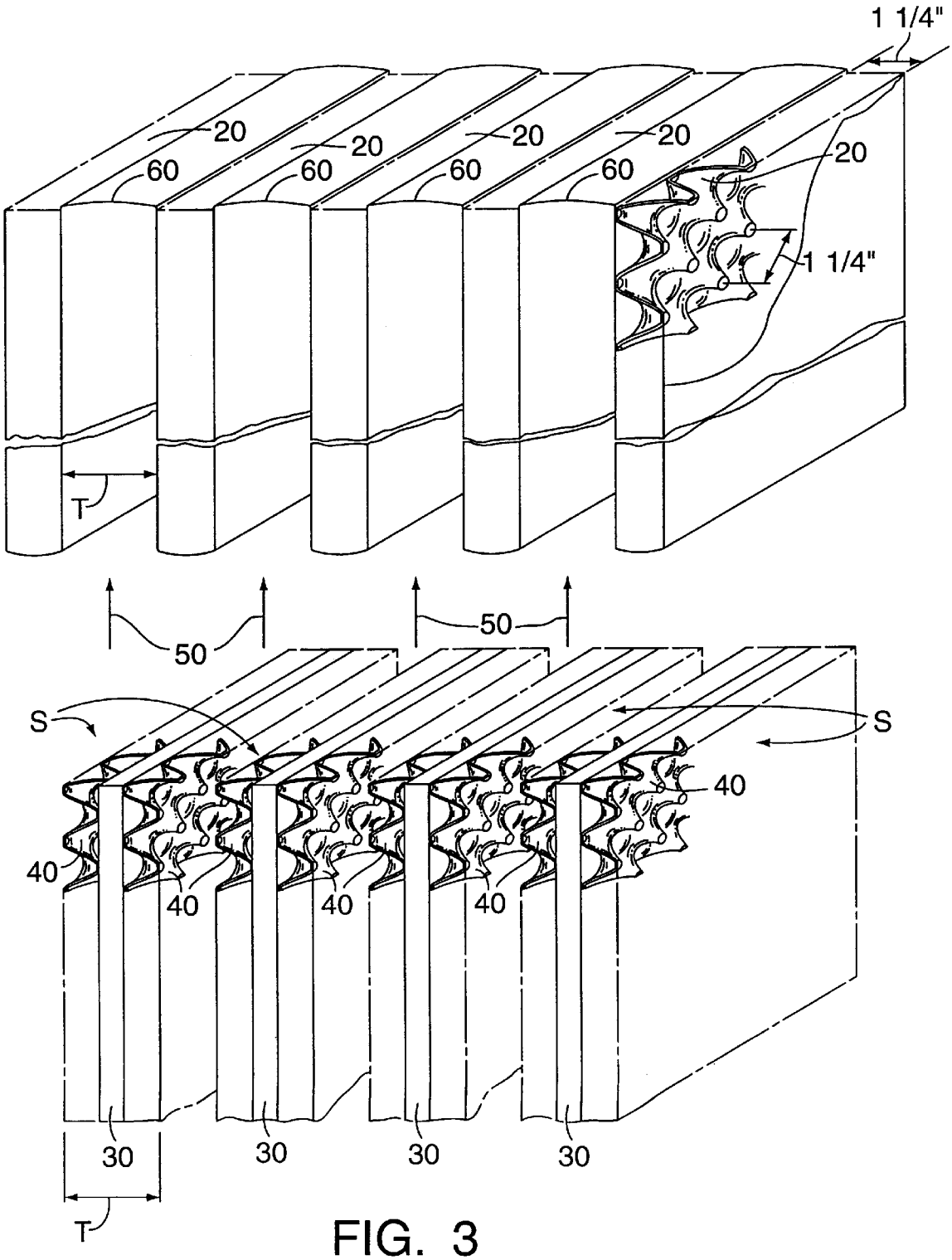
FIG. 3 is a partial perspective exploded view similar to FIG. 2.

Also shown in FIG. 3 are spacer units adapted to fit between the relatively course or wide core sheets 20 in FIG. 3. Each such spacer (four such spacers being shown in FIG. 3) comprises a central slab 30 of inert material, preferably in the form of perlite or peat provided in a sandwich between outer layers of relatively thin core sheet material of the same dimpled construction as that illustrated at 20 in FIG. 3, but having a thickness of no more than one-half the thickness of the core sheet 20. These relatively thin core sheets ¾ inch are illustrated generally at 40,40 in FIG. 3. The overall thickness T of these spacers is such that each spacer will fit between adjacent cores 20,20 as suggested by the arrows 50, 50 in FIG. 3. The preferred thickness T and hence spacing between the core sheets 20,20 is at least two inches and may have a dimension of up to five inches depending upon the type of soil where the installation for a drainage system in accordance with the present invention is to be made. The assembly of the in-drain system of FIG. 3 is completed by providing a serpentine wrap of geotextile fabric 60 as best shown in FIG. 2. Whereas the serpentine wrap of textile fabric in the prior U.S. Pat. No. 4,880,333 provided an upwardly open arrangement for all of the core sheets, the present invention instead utilizes a serpentine wrap that results in covering of the upper edges of the spacers, leaving only the large size core sheets 20 exposed for receiving the leachate fluid from the conduit 10 as best shown in FIG. 1. Nevertheless, it is still necessary that the geotextile fabric 60 cover both faces of the thicker core sheet 20 in the resulting assembly. Such a configuration assures efficient distribution of the liquid delivered to the filter assembly of FIG. 3 by the inlet conduit 10.

Figure 4:
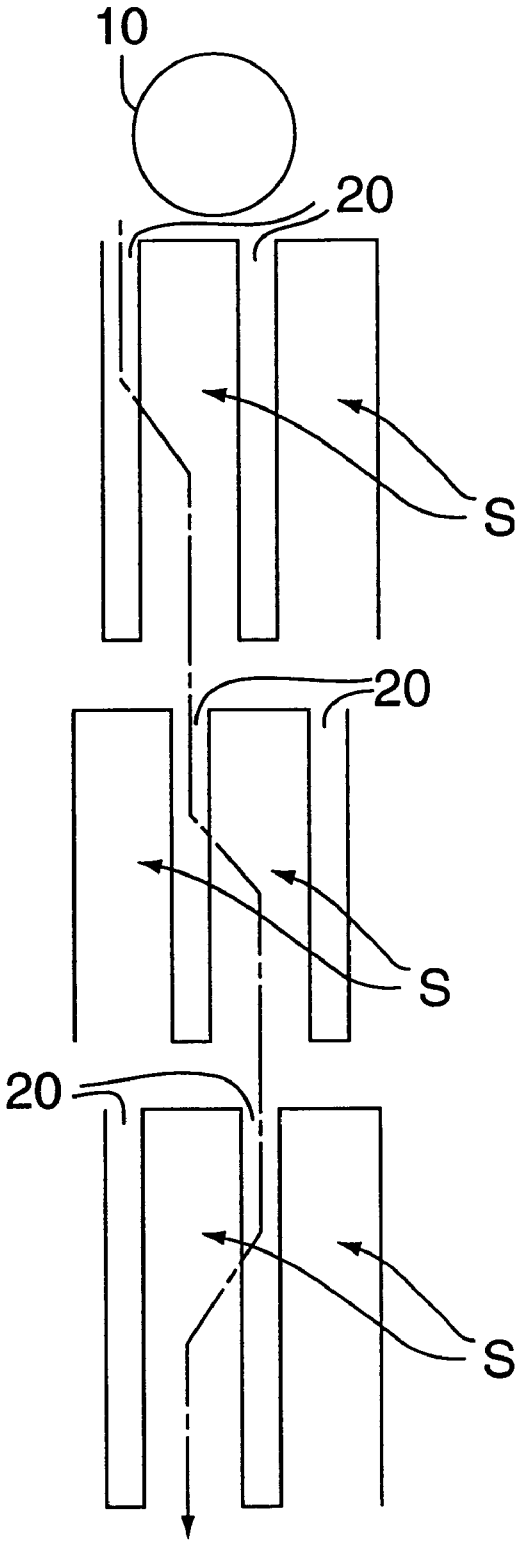
FIG. 4 is an elevational view of an alternative arrangement wherein several in-drain/spacer units are stacked below a single fluid conduit or inlet pipe.

It is a further feature of the present invention that the overall horizontal dimension H of the filtration system of FIG. 3 can be selected such that a single conduit 10 can be provided for feeding fluid to the same, with the overall length L chosen to correspond generally with the length of the inlet conduit 10, and being adjusted to accommodate the flow rates required from the septic tank (not shown). Where the soil surrounding the present system is not porous or sandy enough to allow the length to correspond to the four foot (4') lengths of infiltration units now available, additional such four foot units can be provided along a single outlet pipe, or the infiltration units can be stacked vertically one above another. FIG. 4 shows such a set up, and illustrates how the spacers and in-drains might be staggered to improve effluent fluid flow downwardly through the stack (see broken lines for path of fluid flow). As in the prior U.S. Pat. No. 4,880,333, the inlet conduit may instead comprise a structure similar to that disclosed in said prior Patent, and it is a common feature of both that prior art approach and the present design that an overwrap of geotextile fabric preferably be provided over the inlet conduit 10 of FIG. 1 so as to avoid the propensity of obstructing the openings provided in the pipe 10 at installation, and thereby impeding the efficient operation of the resulting system when the excavation is back filled after excavation of a system constructed in accordance with the present invention. It should be noted that the inlet conduit 10 comprises a perforated pipe, preferably drilled such that the openings 10*a* in the lower portion of the pipe 10 are provided in alignment with the upwardly open tops of the relatively wide core sheets 20 as suggested in FIG. 1. For purposes of precision, these openings 10*a* can be drilled on site in an unperforated pipe of this type, or instead can be predrilled as is the case with presently available perforated pipe generally. Such pipe typically has openings provided in a predrilled fashion which are generally on the order of three inches on center, and hence is well adapted for use as an inlet conduit means in accordance with the present invention.

Other variations of the structure shown and described above will occur to those skilled in the art. For example, the core sheet 20, as well as the narrower outer sheets 40, as used in the above-described embodiment of the invention, may be imperforate and formed from a continuous sheet of polystyrene to have the desired dimple shaped all in accordance with earlier Patents such as Glasser, U.S. Pat. No. 4,490,072. Alternatively, one or both of such core sheets 20,40 might instead be provided of a perforated material such as described in the above-mentioned U.S. Pat. No. 4,880,333. Still another alternative would be to provide imperforate core sheets with drilled openings for purposes of transferring fluid from one side of such sheets to the other, particularly in the spacer units S described above which comprise a central filler of peat moss or the like or wide core 20 sandwiched between two core sheets of relatively small dimension as described previously with reference to the numerals 40,40. Providing through openings in these thin sheets 40 will facilitate the in-drain function by bleeding the fluid away from the core sheets into the central fillers of the spacers.

Another variation that will occur to those skilled in the art when made practicing the present invention, is to provide more than one inlet pipe such as that illustrated at 10, over a given infiltration system of the type described above. While the dimension H in FIG. 1 can be chosen for one such pipe 10 as described above, it would be possible to provide a larger dimension on the order of 2H, and to instead provide two such pipes 10 above it, with the spacing between the pipes being at least. approximately H, and the overall lateral dimension being at least 2H, instead of being H for the infiltration system. Alternatively, with two such outlet pipes and their associated systems of width H, one could space the systems apart and simply add fill between adjacent units. Two such pipes from a given septic tank would allow the distance L to be of somewhat shorter length than would be the case with a single pipe 10 of the type described with reference to the embodiment illustrated in FIGS. 1 and 2.

I claim:

1. A subterranean drainage system for fluid filtration into the surrounding soil comprising:

fluid conduit means oriented generally horizontally to provide an elongated cavity for receiving effluent from a septic tank, at least one fabric sheet provided over said fluid conduit means, and openings in the fluid conduit means for the gravity flow of effluent from the fluid conduit means, fluid filtering means below said conduit means and including a plurality of core sheets oriented in parallel vertical spaced relationship to one another where D equals the pitch distance between said core sheets, spacers of width T provided between said core sheets, said spacers having non-planar end faces abutting said core sheets and said core sheets having a dimpled non-planar contour to provide passageways for the fluid flowing downwardly from said fluid conduit means, said non-planar end faces of said spacers having a contour that avoids nesting between said contoured spacers and said contoured dimpled non-pointer core sheets, and fluid pervious filter fabric wrapped serpentine fashion over each said spacer, between said spacer and an adjacent core sheet, and under each said core sheet, and upwardly between said core sheet and the next adjacent spacer.

2. The system of claim 1 wherein said fluid conduit means comprises at least one elongated generally horizontally extending pipe, said pipe having perforations along a lower portion thereof, said perforations being spaced from one another by a pitch distance of N×D, where N is a whole number and D is the pitch distance between said core sheets.

3. The system according to claim 1 wherein each said spacer more particularly comprises outer sheets of dimpled configuration with a central slab sandwiched therebetween, said outer sheets further defining said passageways in cooperation said dimpled core sheets.

4. The system according to claim 3 wherein said central slab comprises a porous material, and wherein said outer sheets of each said spacer have openings provided therein to define further passageways for fluid from between said core sheets and slabs.

5. The system according to claim 4 wherein said porous material of said slabs comprises a peat material.

6. The system according to claim 5 wherein said fluid conduit means comprises at least one elongated generally horizontally extending pipe, said pipe having perforations along a lower portion thereof, said perforations being spaced from one another by a pitch distance of N×D, where N is a whole number and D is the pitch distance between said core sheets.

7. The system according to claim 4 wherein said porous material of said central slab comprises perlite.

8. The system according to claim 4 wherein said spacer sheets have openings to allow fluid to flow into the central slabs.

9. The system according to claim 3 wherein said dimpled core sheets define raised lands surrounded by valleys defining said passageways as aforesaid.

10. The system according to claim 9 wherein said outer sheets of said spacers also have raised lands surrounded by valleys, said raised lands of said outer sheets of said spacers and said lands of said core sheets having different pitch distances therebetween whereby nesting of said core sheets and spacer outer sheets is prevented.

11. The system according to claim 1 wherein said core sheets have holes to allow fluid to flow from one side to the other side.

* * * * *